US008657705B2

(12) United States Patent
Kim et al.

(10) Patent No.: US 8,657,705 B2
(45) Date of Patent: Feb. 25, 2014

(54) GOLF BALL

(75) Inventors: Hyoungchol Kim, Kobe (JP); Masahide Onuki, Kobe (JP); Kaname Yamada, Kobe (JP)

(73) Assignee: SRI Sports Limited, Kobe (JP)

( * ) Notice: Subject to any disclaimer, the term of this patent is extended or adjusted under 35 U.S.C. 154(b) by 801 days.

(21) Appl. No.: 12/708,760

(22) Filed: Feb. 19, 2010

(65) Prior Publication Data

US 2010/0234141 A1 Sep. 16, 2010

(30) Foreign Application Priority Data

Mar. 13, 2009 (JP) ..... 2009-060401

(51) Int. Cl.
*A63B 37/12* (2006.01)

(52) U.S. Cl.
USPC ..... 473/378

(58) Field of Classification Search
USPC ..... 473/378–385
See application file for complete search history.

(56) References Cited

U.S. PATENT DOCUMENTS

| | | | | |
|---|---|---|---|---|
| 4,744,564 | A | 5/1988 | Yamada | |
| 4,936,587 | A | 6/1990 | Lynch et al. | |
| 5,080,367 | A | 1/1992 | Lynch et al. | |
| 5,292,132 | A | 3/1994 | Oka | |
| 6,776,730 | B2 * | 8/2004 | Moriyama et al. | 473/383 |

* cited by examiner

*Primary Examiner* — Raeann Gorden
(74) *Attorney, Agent, or Firm* — Birch, Stewart, Kolasch & Birch, LLP

(57) ABSTRACT

A golf ball 2 has a large number of dimples 8 and a land 10. A rugged pattern is formed on the surface of the golf ball 2 by these dimples 8 and the land 10. These dimples 8 are arranged in a random manner. Each dimple 8 has a crater shape. For designing the rugged pattern, a Cellular Automaton method is used. A fluctuation range Rh of the golf ball 2 that is an index indicating the aerodynamic characteristic during PH rotation is 1.9 mm or less. A fluctuation range Ro of the golf ball 2 that is an index indicating the aerodynamic characteristic during POP rotation is 1.9 mm or less. The absolute value of the difference dR between the fluctuation range Ro and the fluctuation range Rh is 0.4 mm or less.

9 Claims, 19 Drawing Sheets

GOLF BALL

This application claims priority on Patent Application No. 2009-60401 filed in JAPAN on Mar. 13, 2009. The entire contents of this Japanese Patent Application are hereby incorporated by reference.

BACKGROUND OF THE INVENTION

1. Field of the Invention

The present invention relates to golf balls. Specifically, the present invention relates to improvement in dimples of golf balls.

2. Description of the Related Art

Golf balls have a large number of dimples on the surface thereof. The dimples disturb the air flow around the golf ball during flight to cause turbulent flow separation. By causing the turbulent flow separation, separation points of the air from the golf ball shift backwards leading to a reduction of drag. The turbulent flow separation promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect".

In a golf ball, the ratio of the sum of the areas of all dimples to the area of the phantom sphere is referred to as an occupation ratio. A golf ball with a high occupation ratio achieves a superior dimple effect. U.S. Pat. No. 5,292,132 (JP-H4-347177) discloses a golf ball with an increased occupation ratio.

The United States Golf Association (USGA) has established the rules about symmetry of golf balls. According to the rules, the trajectory during PH (poles horizontal) rotation and the trajectory during POP (poles over pole) rotation are compared with each other. The rotation axis for PH rotation extends through both poles of the golf ball, and the rotation axis for POP rotation is orthogonal to the rotation axis for PH rotation. A golf ball having a large difference between a trajectory during PH rotation and a trajectory during POP rotation, that is, inferior aerodynamic symmetry, does not conform to the rules.

Other than a shot at a teeing ground, golf players cannot decide a hitting place of a golf ball. Thus, a flight distance of a golf ball with inferior aerodynamic symmetry varies. Golf players have difficulty in landing this golf ball at an intended point.

The dimples can be arranged by using a regular polyhedron that is inscribed in the phantom sphere of a golf ball. In this arrangement method, the surface of the phantom sphere is divided into a plurality of units by division lines obtained by projecting the sides of the polyhedron on the spherical surface. The dimple pattern of one unit is developed all over the phantom sphere. According to this dimple pattern, the aerodynamic characteristic in the case where a line passing through a vertex of the regular polyhedron is a rotation axis is different from that in the case where a line passing through the center of a surface of the regular polyhedron is a rotation axis. Such a golf ball has inferior aerodynamic symmetry.

U.S. Pat. No. 4,936,587 (JP-S50-8630) discloses a golf ball having an improved dimple pattern. The surface of the golf ball is divided by an icosahedron that is inscribed in the phantom sphere thereof. Based on this division, dimples are arranged on the surface of the golf ball. According to this dimple pattern, the number of great circles that do not intersect any dimples is 1. This great circle agrees with the equator of the golf ball. The region near the equator is a unique region.

Generally, a golf ball is formed by a mold having upper and lower mold halves. The mold has a parting line. A golf ball obtained by this mold has a seam at a position along the parting line. Through this forming process, spew occurs along the seam. The spew is removed by means of cutting. By cutting the spew, the dimples near the seam are deformed. In addition, the dimples near the seam tend to be orderly arranged. The seam is located along the equator of the golf ball. The region near the equator is a unique region.

A mold having an uneven parting line has been used. A golf ball obtained by this mold has dimples on the equator thereof. The dimples on the equator contribute to eliminating the uniqueness of the region near the equator. However, the uniqueness is not sufficiently eliminated. This golf ball has insufficient aerodynamic symmetry.

U.S. Pat. No. 4,744,564 (JP-S61-284264) discloses a golf ball in which the dimples near the seam are greater in volume than the dimples near the poles. This volume difference contributes to eliminating the uniqueness of the region near the equator.

The golf ball disclosed in U.S. Pat. No. 4,744,564 eliminates, by the volume difference of dimples, the disadvantage caused by the dimple pattern. The disadvantage is eliminated not by modification of the dimple pattern. In the golf ball, the potential of the dimple pattern is sacrificed. The flight distance of the golf ball is insufficient. An object of the present invention is to provide a golf ball having excellent flight performance.

SUMMARY OF THE INVENTION

A golf ball according to the present invention has a large number of dimples, and has a fluctuation range Rh and a fluctuation range Ro each of which is 1.9 mm or less. The fluctuation range Rh and the fluctuation range Ro are obtained by the steps of:

(1) assuming a line connecting both poles of the golf ball as a first rotation axis;

(2) assuming a great circle which exists on a surface of a phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining a region, of a surface of the golf ball, which is obtained by dividing the phantom sphere at the two small circles and which is sandwiched between the two small circles;

(5) determining 30240 points, on the region, arranged at intervals of a central angle of 3° in a direction of the first rotation axis and at intervals of a central angle of 0.25° in a direction of rotation about the first rotation axis;

(6) calculating a length L1 of a perpendicular line which extends from each point to the first rotation axis;

(7) calculating a total length L2 by summing 21 lengths L1 calculated based on 21 perpendicular lines arranged in the direction of the first rotation axis;

(8) determining a maximum value and a minimum value among 1440 total lengths L2 calculated along the direction of rotation about the first rotation axis, and calculating the fluctuation range Rh by subtracting the minimum value from the maximum value;

(9) assuming a second rotation axis orthogonal to the first rotation axis assumed at the step (1);

(10) assuming a great circle which exists on the surface of the phantom sphere of the golf ball and is orthogonal to the second rotation axis;

(11) assuming two small circles which exist on the surface of the phantom sphere of the golf ball, which are orthogonal to the second rotation axis, and of which an absolute value of a central angle with the great circle is 30°;

(12) defining a region, of the surface of the golf ball, which is obtained by dividing the phantom sphere at the two small circles and which is sandwiched between the two small circles;

(13) determining 30240 points, on the region, arranged at intervals of a central angle of 3° in a direction of the second rotation axis and at intervals of a central angle of 0.25° in a direction of rotation about the second rotation axis;

(14) calculating a length L1 of a perpendicular line which extends from each point to the second rotation axis;

(15) calculating a total length L2 by summing 21 lengths L1 calculated based on 21 perpendicular lines arranged in the direction of the second rotation axis; and

(16) determining a maximum value and a minimum value among 1440 total lengths L2 calculated along the direction of rotation about the second rotation axis, and calculating the fluctuation range Ro by subtracting the minimum value from the maximum value.

In the golf ball, a superior dimple effect is achieved. The golf ball has excellent flight performance. The golf ball also has excellent aerodynamic symmetry.

Preferably, an absolute value of a difference dR between the fluctuation range Ro and the fluctuation range Rh is 0.4 mm or less. Preferably, an index Ah that is obtained by dividing the fluctuation range Rh by a total volume of the dimples is 0.0035 $mm^{-2}$ or less, and an index Ao that is obtained by dividing the fluctuation range Ro by the total volume of the dimples is 0.0035 $mm^{-2}$ or less. Preferably, an absolute value of a difference dA between the index Ao and the index Ah is 0.0007 $mm^{-2}$ or less.

Preferably, a total volume of the dimples is 450 $mm^3$ or greater and 700 $mm^3$ or less. Preferably, a ratio of a total area of the dimples to a surface area of the phantom sphere is 70% or greater and 95% or less.

According to another aspect, a golf ball according to the present invention has a large number of dimples, and has a difference dR whose absolute value is 0.4 mm or less. The difference dR is obtained by the steps of:

(1) assuming a line connecting both poles of the golf ball as a first rotation axis;

(2) assuming a great circle which exists on a surface of a phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining a region, of a surface of the golf ball, which is obtained by dividing the phantom sphere at the two small circles and which is sandwiched between the two small circles;

(5) determining 30240 points, on the region, arranged at intervals of a central angle of 3° in a direction of the first rotation axis and at intervals of a central angle of 0.25° in a direction of rotation about the first rotation axis;

(6) calculating a length L1 of a perpendicular line which extends from each point to the first rotation axis;

(7) calculating a total length L2 by summing 21 lengths L1 calculated based on 21 perpendicular lines arranged in the direction of the first rotation axis;

(8) determining a maximum value and a minimum value among 1440 total lengths L2 calculated along the direction of rotation about the first rotation axis, and calculating a fluctuation range Rh by subtracting the minimum value from the maximum value;

(9) assuming a second rotation axis orthogonal to the first rotation axis assumed at the step (1);

(10) assuming a great circle which exists on the surface of the phantom sphere of the golf ball and is orthogonal to the second rotation axis;

(11) assuming two small circles which exist on the surface of the phantom sphere of the golf ball, which are orthogonal to the second rotation axis, and of which an absolute value of a central angle with the great circle is 30°;

(12) defining a region, of the surface of the golf ball, which is obtained by dividing the phantom sphere at the two small circles and which is sandwiched between the two small circles;

(13) determining 30240 points, on the region, arranged at intervals of a central angle of 3° in a direction of the second rotation axis and at intervals of a central angle of 0.25° in a direction of rotation about the second rotation axis;

(14) calculating a length L1 of a perpendicular line which extends from each point to the second rotation axis;

(15) calculating a total length L2 by summing 21 lengths L1 calculated based on 21 perpendicular lines arranged in the direction of the second rotation axis;

(16) determining a maximum value and a minimum value among 1440 total lengths L2 calculated along the direction of rotation about the second rotation axis, and calculating a fluctuation range Ro by subtracting the minimum value from the maximum value; and

(17) calculating the difference dR by subtracting the fluctuation range Rh from the fluctuation range Ro.

DESCRIPTION OF THE PREFERRED EMBODIMENTS

The following will describe in detail the present invention based on preferred embodiments with reference to the accompanying drawings.

Figure 1:
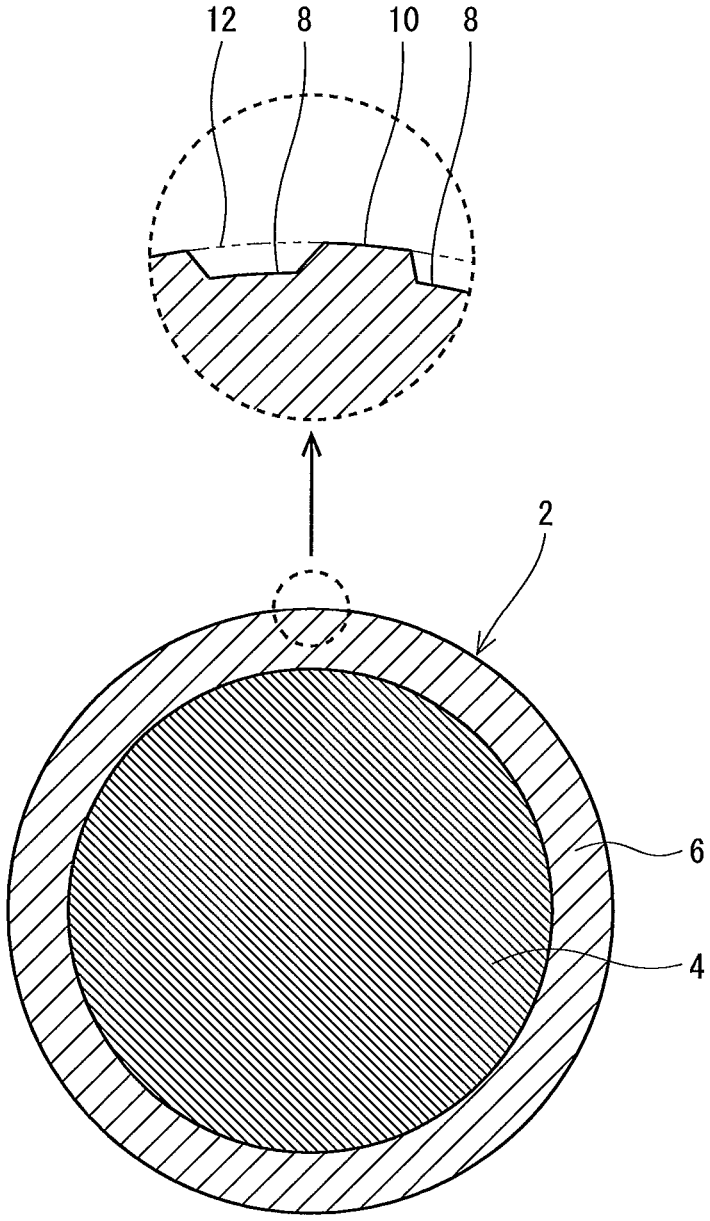
FIG. 1 is a schematic cross-sectional view of a golf ball according to one embodiment of the present invention.

A golf ball 2 shown in FIG. 1 includes a spherical core 4 and a cover 6. On the surface of the cover 6, a large number of dimples 8 are formed. Of the surface of the golf ball 2, a part other than the dimples 8 is a land 10. The golf ball 2 includes a paint layer and a mark layer on the external side of the cover 6 although these layers are not shown in the drawing. A mid layer may be provided between the core 4 and the cover 6.

The diameter of the golf ball 2 is 40 mm or greater and 45 mm or less. From the standpoint of conformity to the rules established by the United States Golf Association (USGA), the diameter is more preferably 42.67 mm or greater. In light of suppression of air resistance, the diameter is more preferably 44 mm or less and particularly preferably 42.80 mm or less. The weight of the golf ball 2 is 40 g or greater and 50 g or less. In light of attainment of great inertia, the weight is more preferably 44 g or greater and particularly preferably 45.00 g or greater. From the standpoint of conformity to the rules established by the USGA, the weight is more preferably 45.93 g or less.

The core 4 is formed by crosslinking a rubber composition. Examples of base rubbers for use in the rubber composition include polybutadienes, polyisoprenes, styrene-butadiene copolymers, ethylene-propylene-diene copolymers, and natural rubbers. Two or more types of these rubbers may be used in combination. In light of resilience performance, polybutadienes are preferred, and in particular, high-cis polybutadienes are preferred.

In order to crosslink the core 4, a co-crosslinking agent can be used. Examples of preferable co-crosslinking agents in light of resilience performance include zinc acrylate, magnesium acrylate, zinc methacrylate, and magnesium methacrylate. Preferably, the rubber composition includes an organic peroxide together with a co-crosslinking agent. Examples of suitable organic peroxides include dicumyl peroxide, 1,1-bis (t-butylperoxy)-3,3,5-trimethylcyclohexane, 2,5-dimethyl-2, 5-di(t-butylperoxy)hexane, and di-t-butyl peroxide.

According to need, various additives such as sulfur, a sulfur compound, a filler, an anti-aging agent, a coloring agent, a plasticizer, a dispersant, and the like are included in the rubber composition for the core 4 in an adequate amount. Crosslinked rubber powder or synthetic resin powder may be also included in the rubber composition.

The diameter of the core 4 is 30.0 mm or greater and particularly 38.0 mm or greater. The diameter of the core 4 is 42.0 mm or less and particularly 41.5 mm or less. The core 4 may be formed with two or more layers.

A suitable polymer for the cover 6 is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, other polymers may be used for the cover 6. Examples of the other polymers include polyurethanes, polystyrenes, polyamides, polyesters, and polyolefins. In light of spin performance and scuff resistance, polyurethanes are preferred. Two or more types of polymers may be used in combination.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 6 in an adequate amount. For the purpose of adjusting specific gravity, powder of a metal with a high specific gravity such as tungsten, molybdenum, and the like may be included in the cover 6.

The thickness of the cover 6 is 0.3 mm or greater and particularly 0.5 mm or greater. The thickness of the cover 6 is 2.5 mm or less and particularly 2.2 mm or less. The specific gravity of the cover 6 is 0.90 or greater and particularly 0.95 or greater. The specific gravity of the cover 6 is 1.10 or less and particularly 1.05 or less. The cover 6 may be formed with two or more layers.

Figure 2:
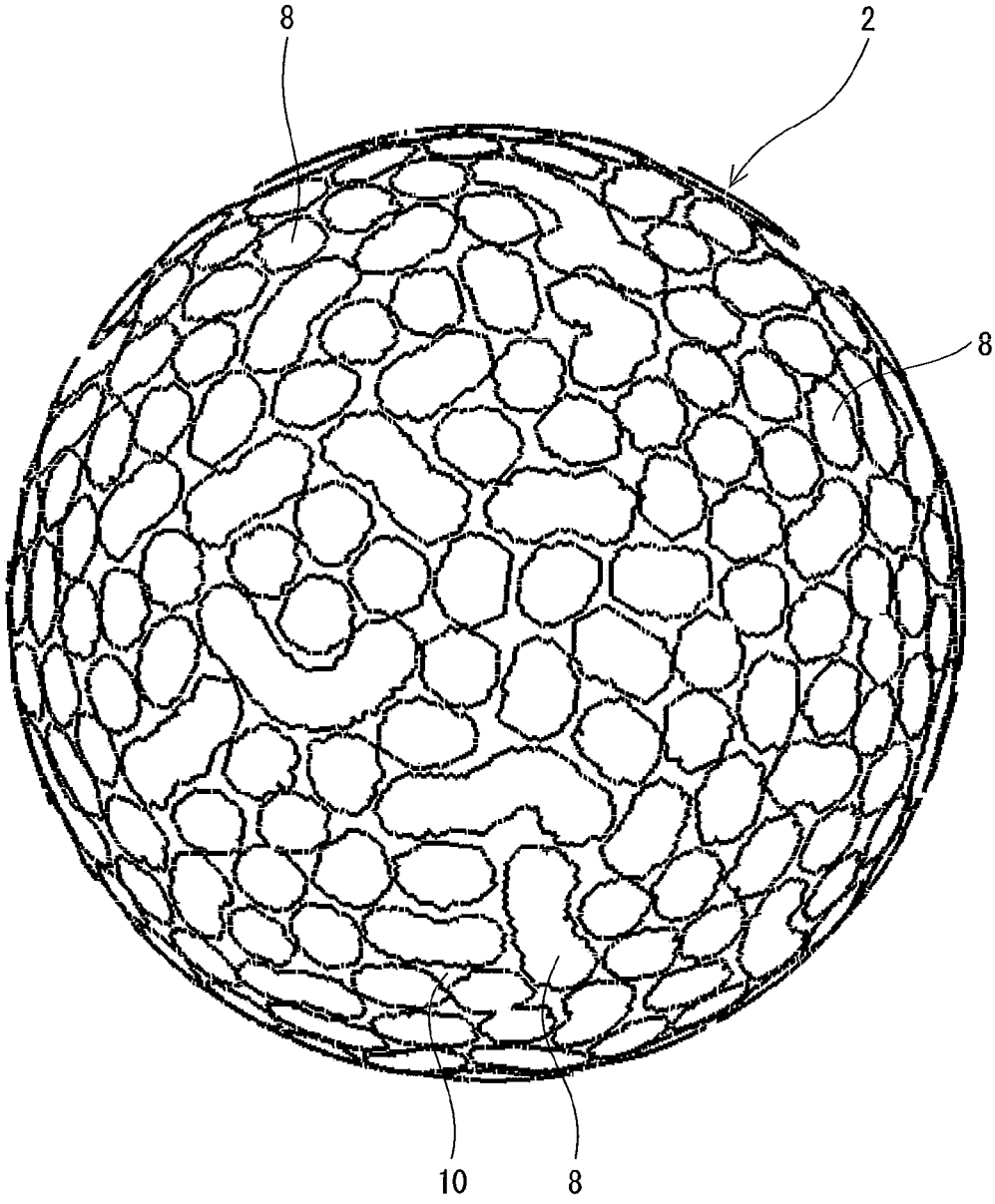
FIG. 2 is an enlarged front view of the golf ball in FIG. 1.

FIG. 2 is an enlarged front view of the golf ball 2 in FIG. 1. As is clear from FIG. 2, a large number of the dimples 8 are arranged in a random manner. By these dimples 8 and the land 10, a rugged pattern is formed on the surface of the golf ball 2. Each dimple 8 has a crater shape. For designing the rugged pattern, a Cellular Automaton method is used. The Cellular Automaton method is described in detail in Japanese Patent Application No. 2008-261266.

In FIG. 1, what is indicated by a reference numeral 12 is a phantom sphere. The surface of the phantom sphere 12 is the surface of the golf ball 2 when it is postulated that no dimple 8 exists. In the present invention, the term "dimple volume" means the volume of a part surrounded by the phantom sphere 12 and the surface of the dimple 8. In light of suppression of rising of the golf ball 2 during flight, the sum of the volumes (total volume) of all the dimples 8 is preferably 400 $mm^3$ or greater and particularly preferably 450 $mm^3$ or greater. In light of suppression of dropping of the golf ball 2 during flight, the total volume is preferably 700 $mm^3$ or less and particularly preferably 650 $mm^3$ or less.

Figure 3:
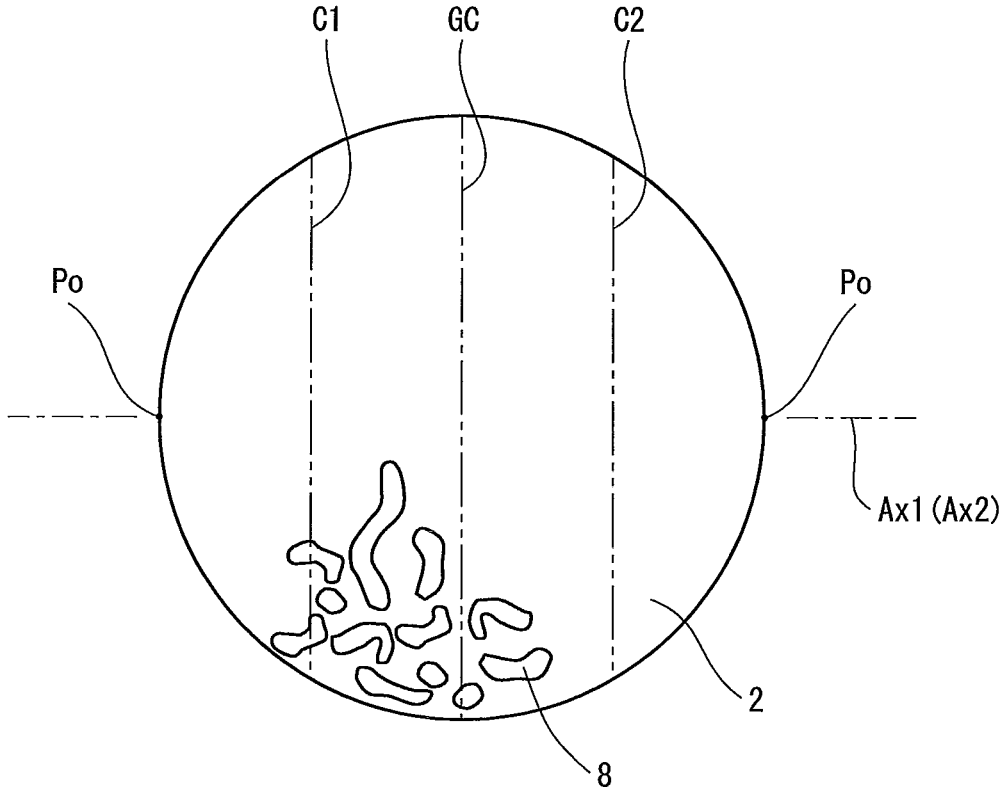
FIG. 3 is a schematic view for explaining a method of calculating fluctuation ranges of the golf ball in FIG. 2.

The golf ball 2 has a fluctuation range Rh and a fluctuation range Ro each of which is 1.9 mm or less. The fluctuation ranges Rh and Ro are indexes that correlate with the aerodynamic characteristic of the golf ball 2. FIG. 3 is a schematic view for explaining a method of calculating the fluctuation ranges Rh and Ro. In this method, a first rotation axis Ax1 is assumed. The first rotation axis Ax1 passes through the two poles Po of the golf ball 2. Each pole Po corresponds to a deepest part of the mold used for forming the golf ball 2. One of the poles Po corresponds to the deepest part of an upper mold half, and the other pole Po corresponds to the deepest part of a lower mold half. The golf ball 2 rotates about the first rotation axis Ax1. This rotation is referred to as PH rotation.

Figure 4:
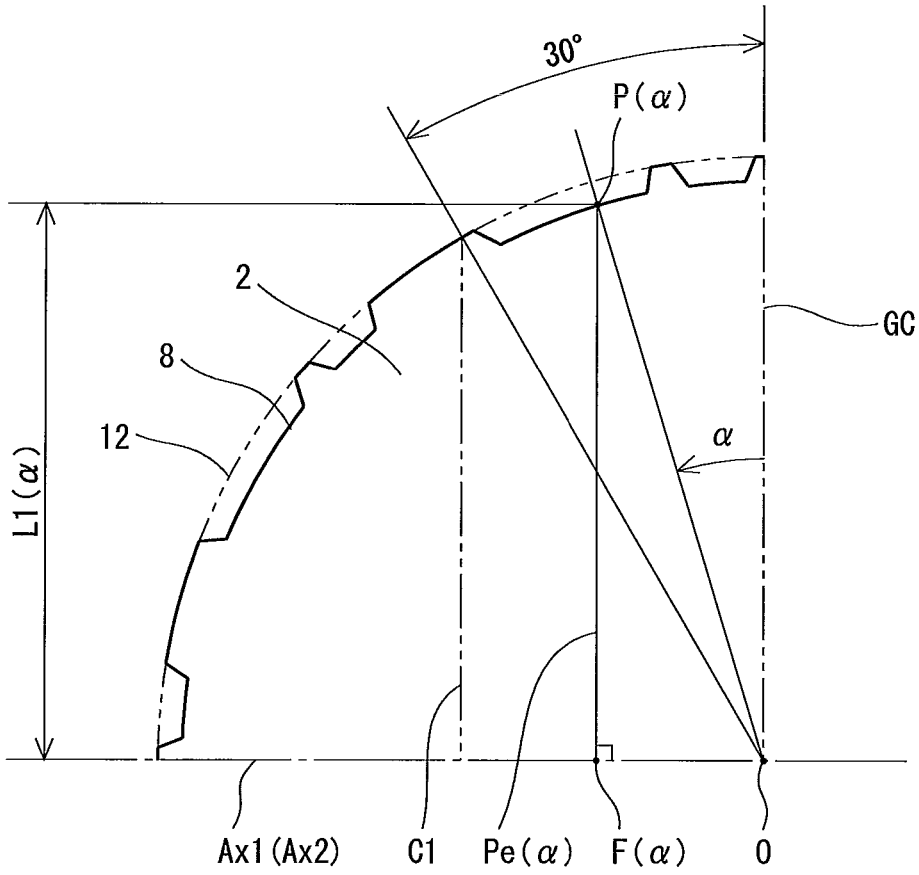
FIG. 4 is a partial cross-sectional view of the golf ball in FIG. 3.

There is assumed a great circle GC that exists on the surface of the phantom sphere 12 of the golf ball 2 and is orthogonal to the first rotation axis Ax1. The circumferential speed of the great circle GC is faster than any other part of the golf ball 2 during rotation of the golf ball 2. In addition, there are assumed two small circles C1 and C2 that exist on the surface of the phantom sphere 12 of the golf ball 2 and are orthogonal to the first rotation axis Ax1. FIG. 4 schematically shows a partial cross section of the golf ball 2 in FIG. 3. In FIG. 4, the right-to-left direction is the direction of the first rotation axis Ax1. As shown in FIG. 4, the absolute value of the central angle between the small circle C1 and the great circle GC is 30°. Although not shown in the drawing, the absolute value of the central angle between the small circle C2 and the great circle GC is also 30°. The phantom sphere 12 is divided at the small circles C1 and C2, and of the surface of the golf ball 2, a region sandwiched between the small circles C1 and C2 is defined.

In FIG. 4, a point P(α) is the point that is located on the surface of the golf ball 2 and of which the central angle with the great circle GC is α° (degree). A point F(α) is a foot of a perpendicular line Pe(α) that extends downward from the point P(α) to the first rotation axis Ax1. What is indicated by an arrow L1(α) is the length of the perpendicular line Pe(α). In other words, the length L1(α) is the distance between the point P(α) and the first rotation axis Ax1. For one cross section, the lengths L1(α) are calculated at 21 points P(α). Specifically, the lengths L1(α) are calculated at angles α of −30°, −27°, −24°, −21°, −18°, −15°, −12°, −9°, −6°, −3°, 0°, 3°, 6°, 9°, 12°, 15°, 18°, 21°, 24°, 27°, and 30°. The 21 lengths L1(α) are summed to obtain a total length L2 (mm). The total length L2 is a parameter dependent on the surface shape in the cross section shown in FIG. 4.

Figure 5:
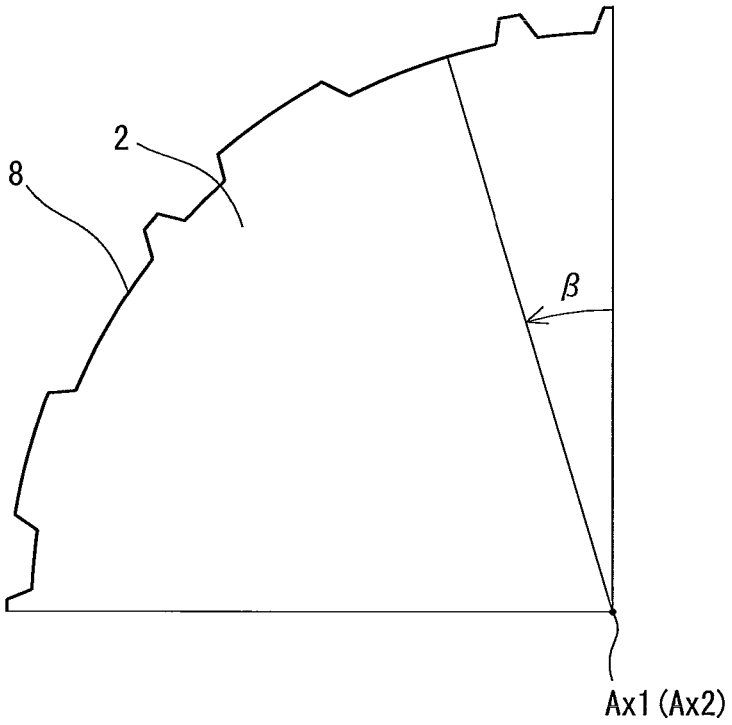
FIG. 5 is a partial cross-sectional view of the golf ball in FIG. 3.

FIG. 5 shows a partial cross section of the golf ball 2. In FIG. 5, the direction perpendicular to the surface of the sheet is the direction of the first rotation axis Ax1. In FIG. 5, what is indicated by a reference sign β is a rotation angle of the golf ball 2. In a range equal to or greater than 0° and less than 360°, the rotation angles β are set at an interval of an angle of 0.25°. At each rotation angle, the total length L2 is calculated. As a result, 1440 total lengths L2 are obtained along the rotation direction. These total lengths L2 are calculated based on the 30240 lengths L1.

Figure 6:
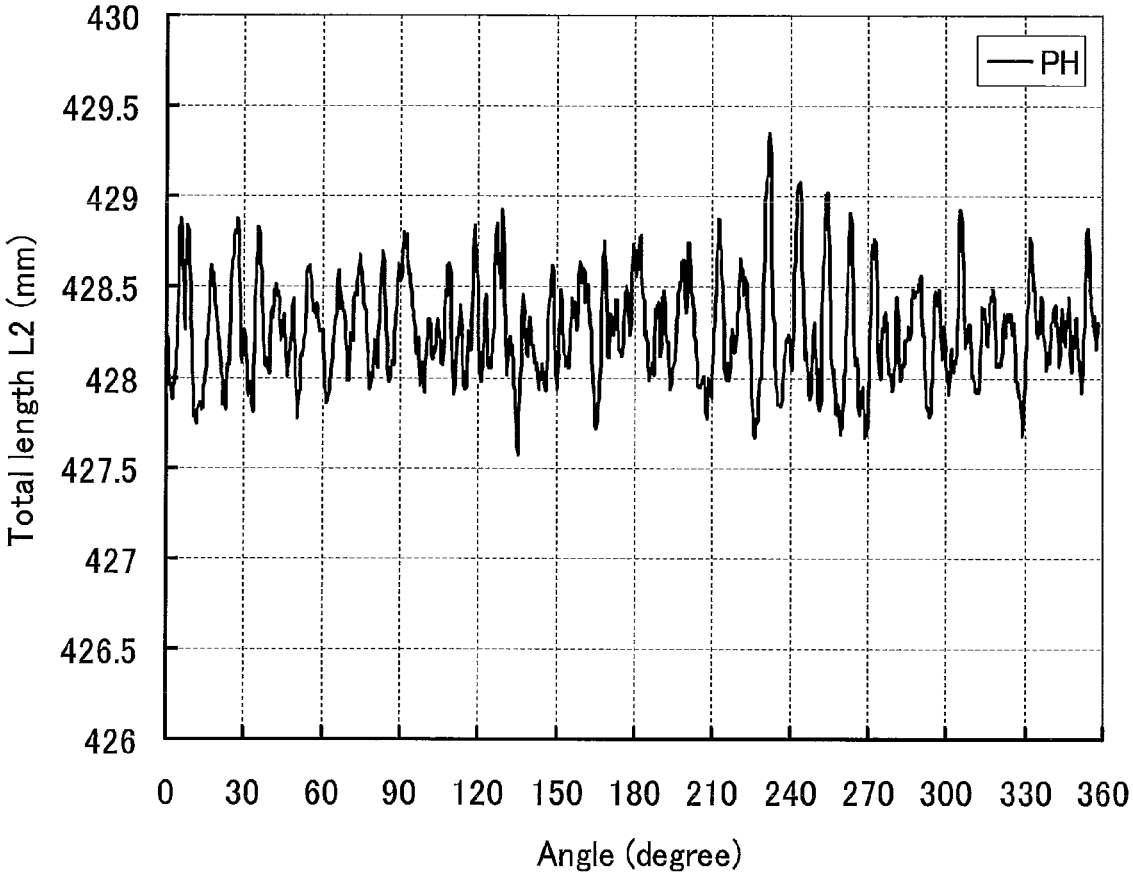
FIG. 6 is a graph for calculating a fluctuation range Rh of the golf ball in FIG. 2.

FIG. 6 is a graph for calculating the fluctuation range Rh of the golf ball 2 in FIG. 2. In this graph, the horizontal axis indicates the rotation angle β, and the vertical axis indicates the total length L2. From this graph, the maximum and minimum values of the total length L2 are determined. The minimum value is subtracted from the maximum value to calculate the fluctuation range Rh. The fluctuation range Rh is an index indicating the aerodynamic characteristic during PH rotation.

Further, a second rotation axis Ax2 orthogonal to the first rotation axis Ax1 is determined. Rotation of the golf ball 2 about the second rotation axis Ax2 is referred to as POP rotation. Similarly as for PH rotation, for POP rotation, a great circle GC and two small circles C1 and C2 are assumed. The absolute value of the central angle between the small circle C1 and the great circle GC is 30°. The absolute value of the central angle between the small circle C2 and the great circle GC is also 30°. For a region, sandwiched between the small circles C1 and C2, of the surface of the golf ball 2, 1440 total lengths L2 are calculated.

Figure 7:
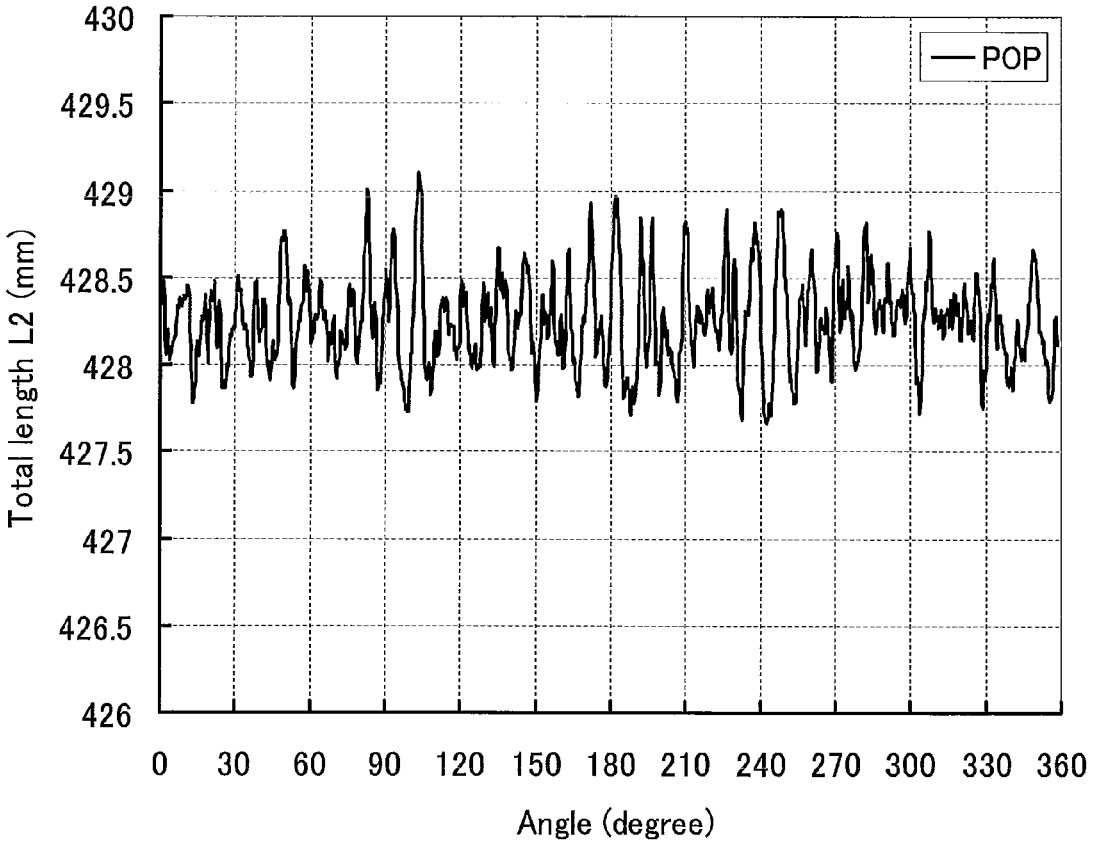
FIG. 7 is a graph for calculating a fluctuation range Ro of the golf ball in FIG. 2.

FIG. 7 is a graph for calculating the fluctuation range Ro of the golf ball 2 in FIG. 2. In this graph, the horizontal axis indicates the rotation angle β, and the vertical axis indicates the total length L2. From this graph, the maximum and minimum values of the total length L2 are determined. The minimum value is subtracted from the maximum value to calculate the fluctuation range Ro. The fluctuation range Ro is an index indicating the aerodynamic characteristic during POP rotation.

The fluctuation range Rh is subtracted from the fluctuation range Ro to calculate a difference dR. The difference dR is an index indicating the aerodynamic symmetry of the golf ball 2. According to the finding by the inventors of the present invention, the golf ball 2 with a low absolute value of the difference dR has excellent aerodynamic symmetry. It is inferred that this is because the similarity between the surface shape during PH rotation and the surface shape during POP rotation is high.

There are numerous straight lines orthogonal to the first rotation axis Ax1. Thus, there are also numerous great circles GC corresponding to POP rotation. A great circle GC, whose part included in the dimples 8 is the longest, is selected, and a fluctuation range Ro and a difference dR are calculated. Instead of this, 20 great circles GC may be extracted in a random manner, and 20 fluctuation ranges Ro may be calculated based on the extracted 20 great circles GC. In this case, a difference dR is calculated based on the maximum value among 20 pieces of data.

The smaller the fluctuation ranges Rh and Ro are, the larger the flight distance at PH rotation is. The detailed reason has not been identified, but it is inferred that this is because transition of turbulent flow continues smoothly. In light of flight distance, the fluctuation range Rh is preferably 1.9 mm or less, more preferably 1.50 mm or less, and particularly preferably 1.43 mm or less. In light of flight distance, the fluctuation range Ro is preferably 1.9 mm or less, more preferably 1.80 mm or less, and particularly preferably 1.77 mm or less. In light of aerodynamic symmetry, the absolute value of the difference dR is preferably 0.4 mm or less, more preferably 0.35 mm or less, and particularly preferably 0.34 mm or less.

The fluctuation range Rh (mm) is divided by the total volume ($mm^3$) of the dimples 8 to calculate an index Ah. The index Ah indicates the aerodynamic characteristic during PH rotation.

The fluctuation range Ro (mm) is divided by the total volume ($mm^3$) of the dimples 8 to calculate an index Ao. The index Ao indicates the aerodynamic characteristic during POP rotation. In light of flight distance, the index Ah is preferably 0.0035 $mm^{-2}$ or less, more preferably 0.0028 $mm^{-2}$ or less, and particularly preferably 0.0026 $mm^{-2}$ or less. In light of flight distance, the index Ao is preferably 0.0035 $mm^{-2}$ or less, more preferably 0.0034 $mm^{-2}$ or less, and particularly preferably 0.0032 $mm^{-2}$ or less. In light of aerodynamic symmetry, the absolute value of the difference dA between the index Ao and the index Ah is preferably 0.0007 $mm^{-2}$ or less, more preferably 0.0006 $mm^{-2}$ or less, and particularly preferably 0.0003 $mm^{-2}$ or less.

Each index of the golf ball 2 shown in FIG. 2 will be shown below.

Total volume of dimples 8: 550 $mm^3$
PH Rotation
Maximum value of total length L2: 429.09 mm
Minimum value of total length L2: 427.66 mm
Fluctuation range Rh: 1.43 mm
Index Ah: 0.0026 $mm^{-2}$
POP Rotation
Maximum value of total length L2: 429.35 mm
Minimum value of total length L2: 427.58 mm
Fluctuation range Ro: 1.77 mm
Index Ao: 0.0032 $mm^{-2}$
Absolute value of dR: 0.34 mm
Absolute value of dA: 0.0006 $mm^{-2}$ The following Table 1 shows each index calculated for commercially available golf balls.

TABLE 1

| Commercially Available Golf Balls | | | | | |
|---|---|---|---|---|---|
| | Commercially Available Product | | | | |
| | A | B | C | D | E |
| Total Volume ($mm^3$) | 580 | 600 | 585 | 590 | 660 |
| Ro (mm) | 3.52 | 3.46 | 4.50 | 4.07 | 3.87 |
| Rh (mm) | 0.84 | 1.44 | 0.82 | 1.57 | 1.01 |
| dR (mm) | 2.68 | 2.02 | 3.68 | 2.50 | 2.86 |
| Ao ($mm^{-2}$) | 0.0061 | 0.0058 | 0.0077 | 0.0069 | 0.0059 |
| Ah ($mm^{-2}$) | 0.0014 | 0.0024 | 0.0014 | 0.0027 | 0.0015 |
| dA ($mm^{-2}$) | 0.0047 | 0.0034 | 0.0063 | 0.0042 | 0.0044 |

As is clear from the comparison with the commercially available golf balls, the fluctuation ranges Rh and Ro of the golf ball 2 shown in FIG. 2 are small, and the indexes Ah and Ao of the golf ball 2 are also low. In the golf ball 2, a long flight distance is obtained. The absolute values of dR and dA of the golf ball 2 shown in FIG. 2 are low. The golf ball 2 has excellent aerodynamic symmetry.

As described above, the surface of the phantom sphere 12 consist of the land 10 and a large number of the dimples 8. The total area of the dimples 8 is obtained by subtracting the area of the land 10 from the surface area of the phantom sphere 12. The ratio of the total area to the surface area of the phantom sphere 12 (occupation ratio) is preferably 70% or greater. The golf ball 2 with the occupation ratio being 70% or greater has excellent flight performance. In this respect, the occupation ratio is more preferably 74% or greater and particularly preferably 78% or greater. The occupation ratio is preferably 95% or less. According to the golf ball 2 shown in FIG. 2, the total area of the dimples 8 is 4516.9 $mm^2$. The surface area of the phantom sphere 12 of the golf ball 2 is 5728.0 $mm^2$, and thus the occupation ratio is 79%.

The dimple pattern of the golf ball 2 is obtained by the Cellular Automaton method as described above. Due to the Cellular Automaton method, the golf ball 2 with a low absolute value of dR and a high occupation ratio can be obtained. The dimple pattern may be obtained by other methods.

EXAMPLES

The following will show the effects of the present invention by means of Examples, but the present invention should not be construed in a limited manner based on the description of these Examples.

Examples 1 to 3 and Comparative Examples 1 and 2

Figure 8:
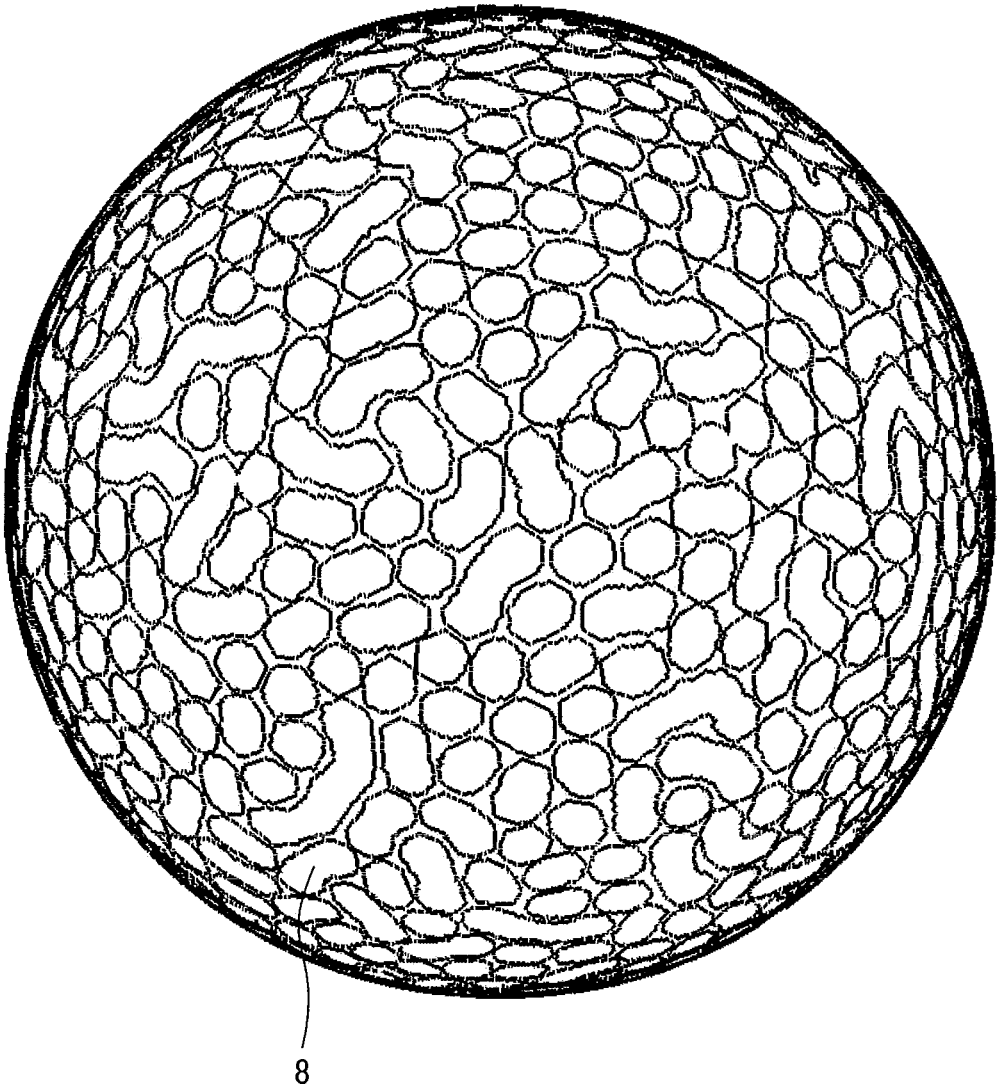
FIG. 8 is a front view of a golf ball according to Example 2 of the present invention.
Figure 11:
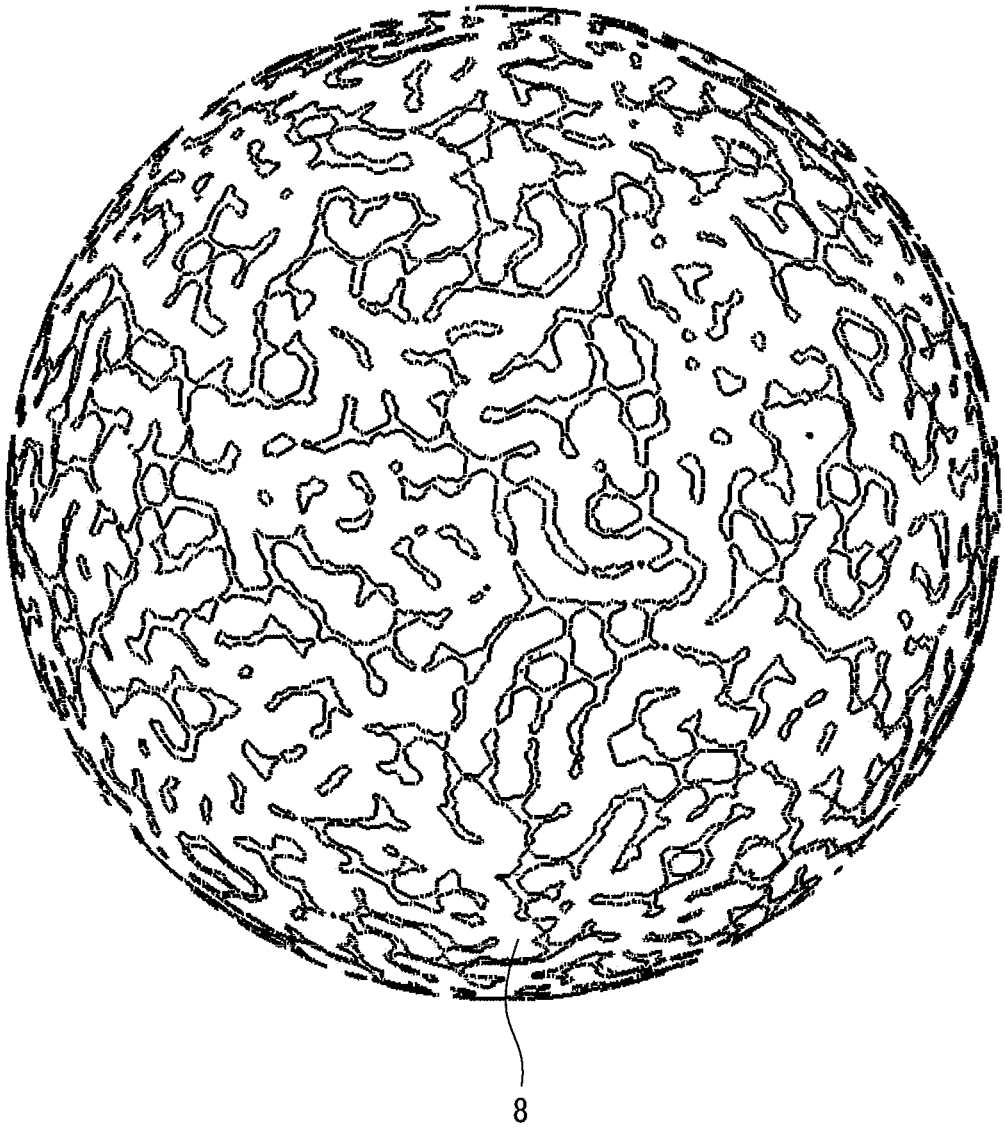
FIG. 11 is a front view of a golf ball according to Example 3 of the present invention.
Figure 14:
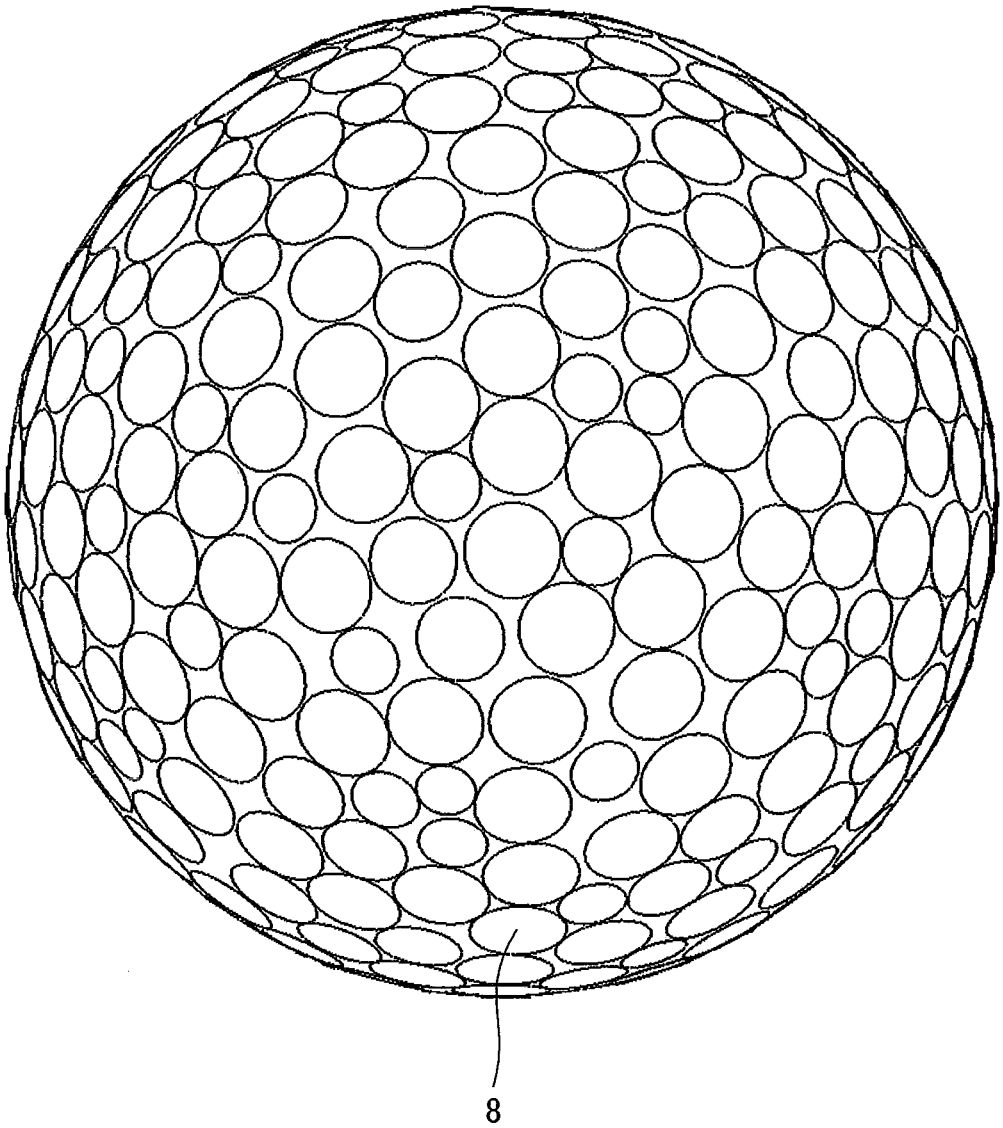
FIG. 14 is a front view of a golf ball according to Comparative Example 1.
Figure 17:
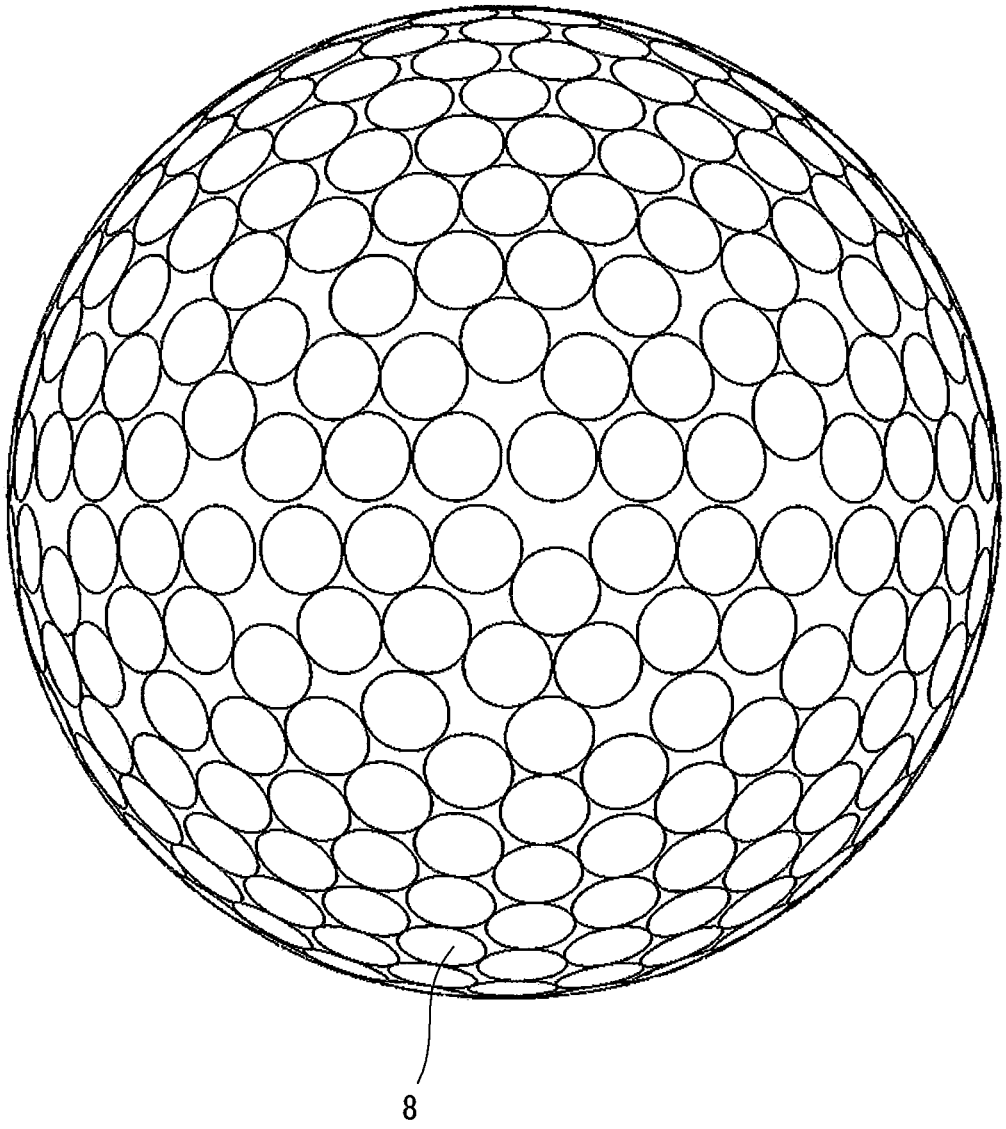
FIG. 17 is a front view of a golf ball according to Comparative Example 2.

Patterns of Examples 1 to 3 and Comparative Examples 1 and 2 were designed. The patterns of Examples 1 to 3 were designed by the Cellular Automaton method. The pattern of Example 1 is shown in FIG. 2. The pattern of Example 2 is shown in FIG. 8. The pattern of Example 3 is shown in FIG. 11. The pattern of Comparative Example 1 is shown in FIG. 14. The pattern of Comparative Example 2 is shown in FIG. 17.

[Analysis]

By the above methods, Ro, Rh, dR, Ao, Ah, and dA of each pattern were calculated. The results are shown in the following Table 2.

TABLE 2

Figure 9:
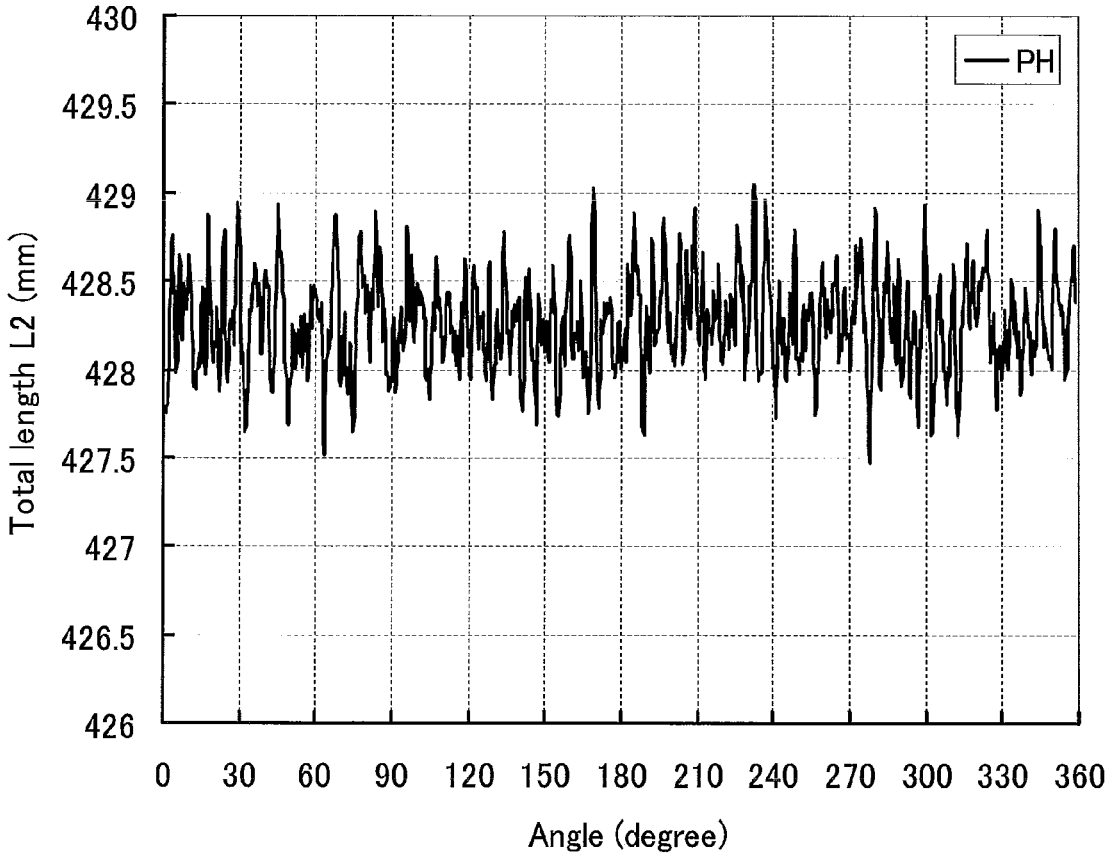
FIG. 9 is a graph for calculating a fluctuation range Rh of the golf ball in FIG. 8.
Figure 10:
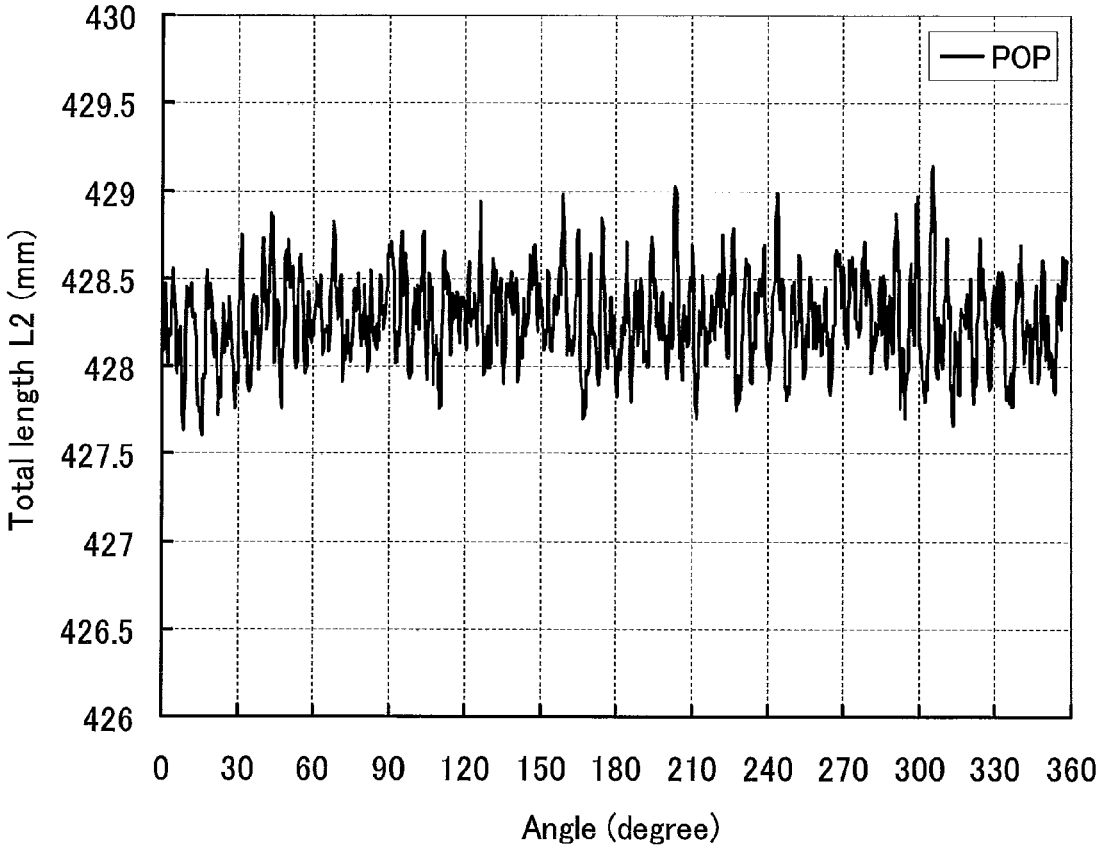
FIG. 10 is a graph for calculating a fluctuation range Ro of the golf ball in FIG. 8.
Figure 12:
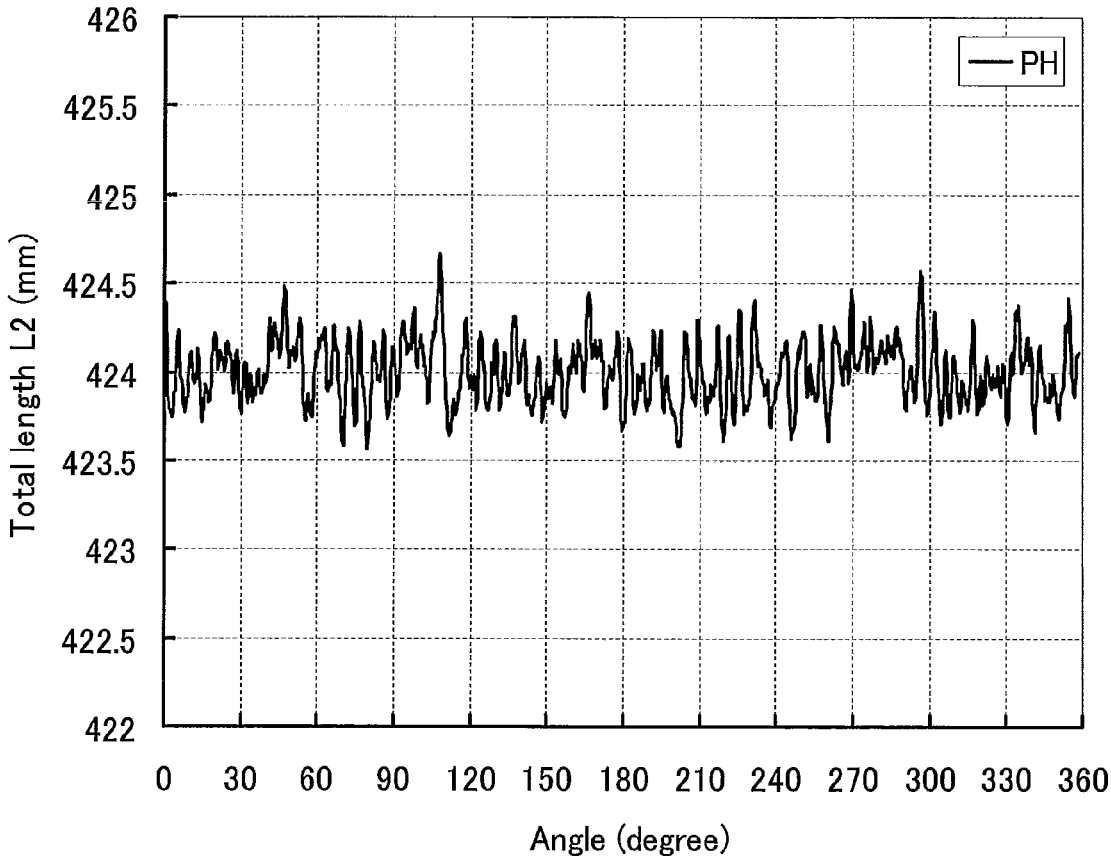
FIG. 12 is a graph for calculating a fluctuation range Rh of the golf ball in FIG. 11.
Figure 13:
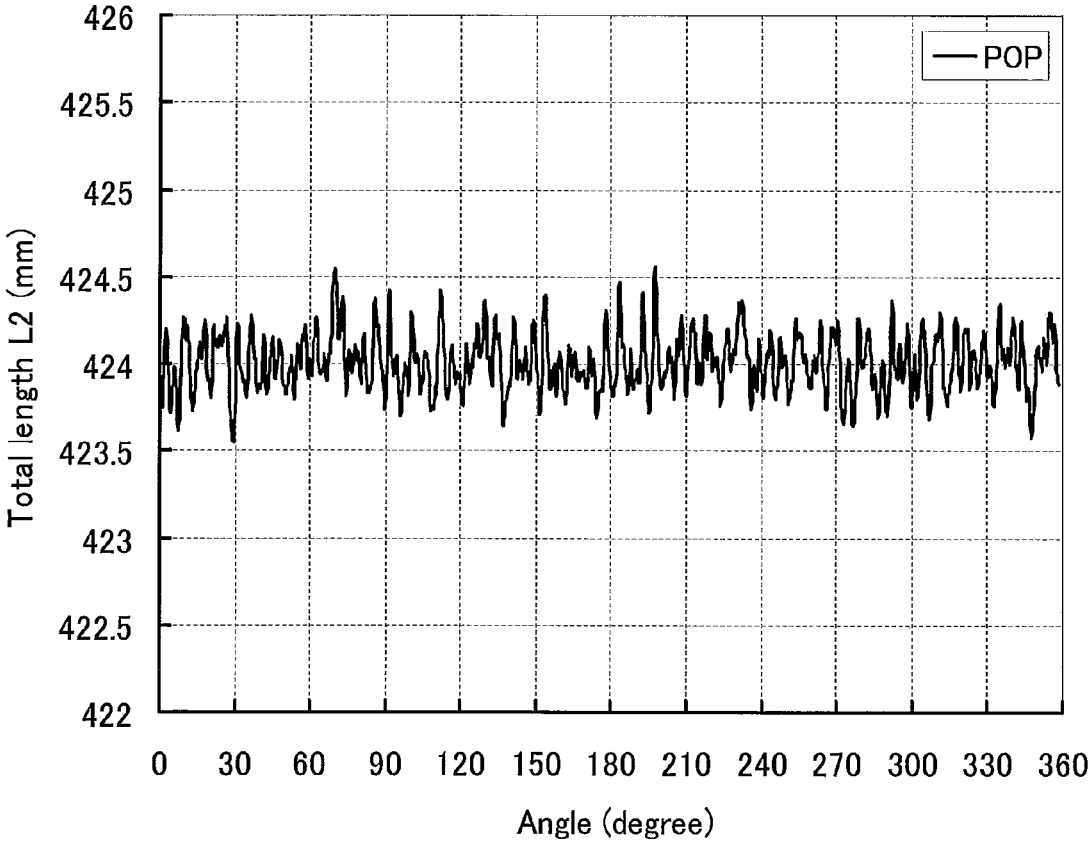
FIG. 13 is a graph for calculating a fluctuation range Ro of the golf ball in FIG. 11.
Figure 15:
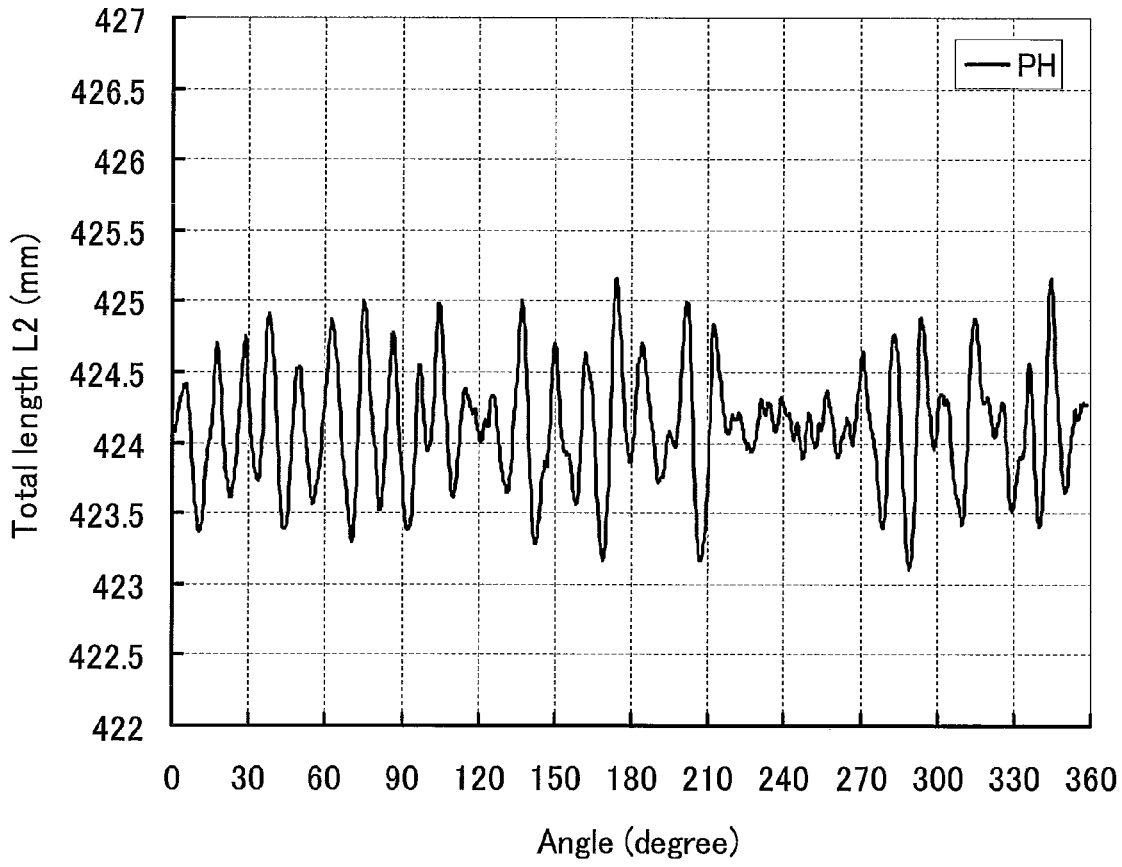
FIG. 15 is a graph for calculating a fluctuation range Rh of the golf ball in FIG. 14.
Figure 16:
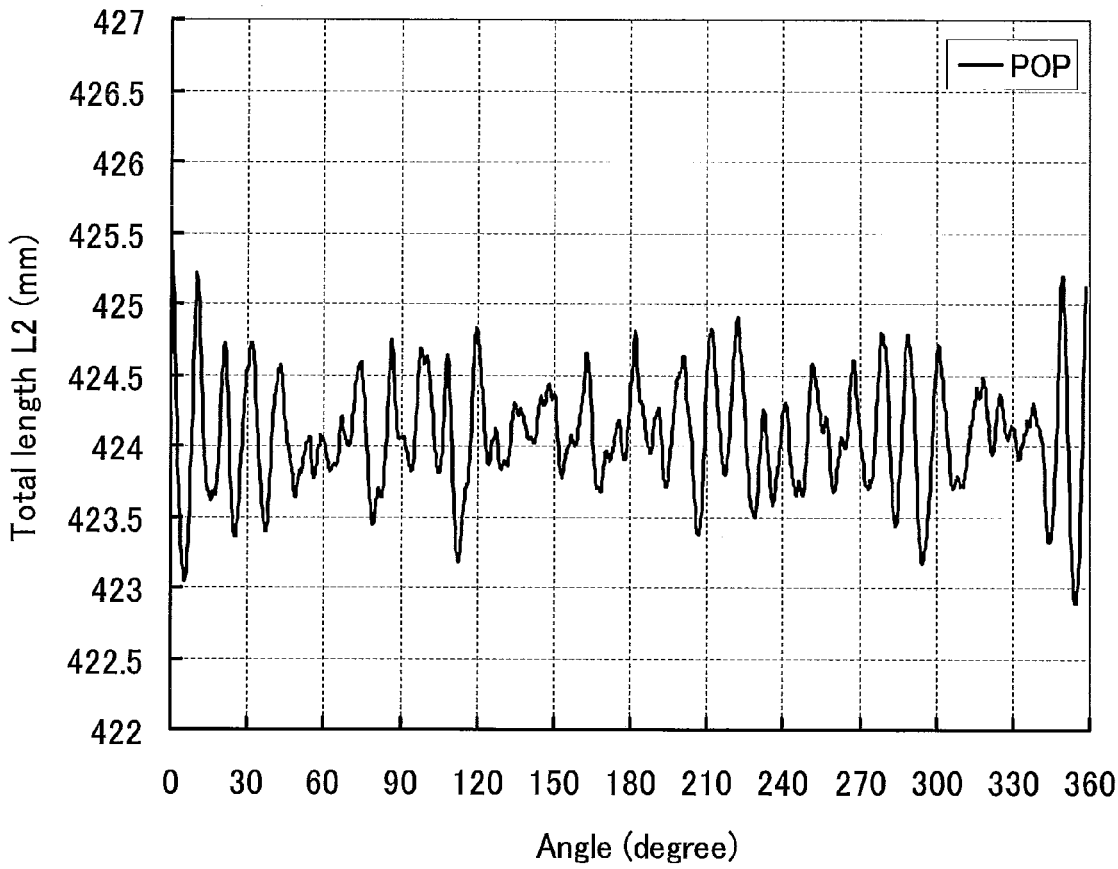
FIG. 16 is a graph for calculating a fluctuation range Ro of the golf ball in FIG. 14
Figure 18:
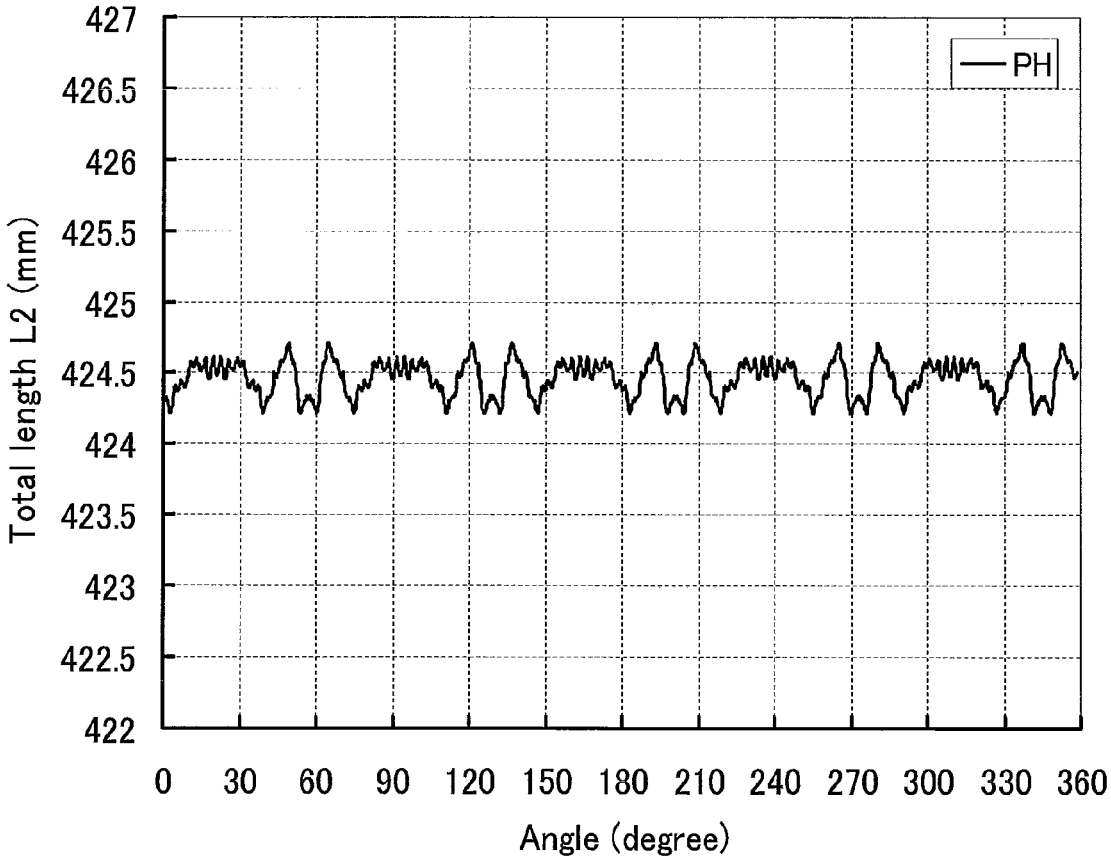
FIG. 18 is a graph for calculating a fluctuation range Rh of the golf ball in FIG. 17.
Figure 19:
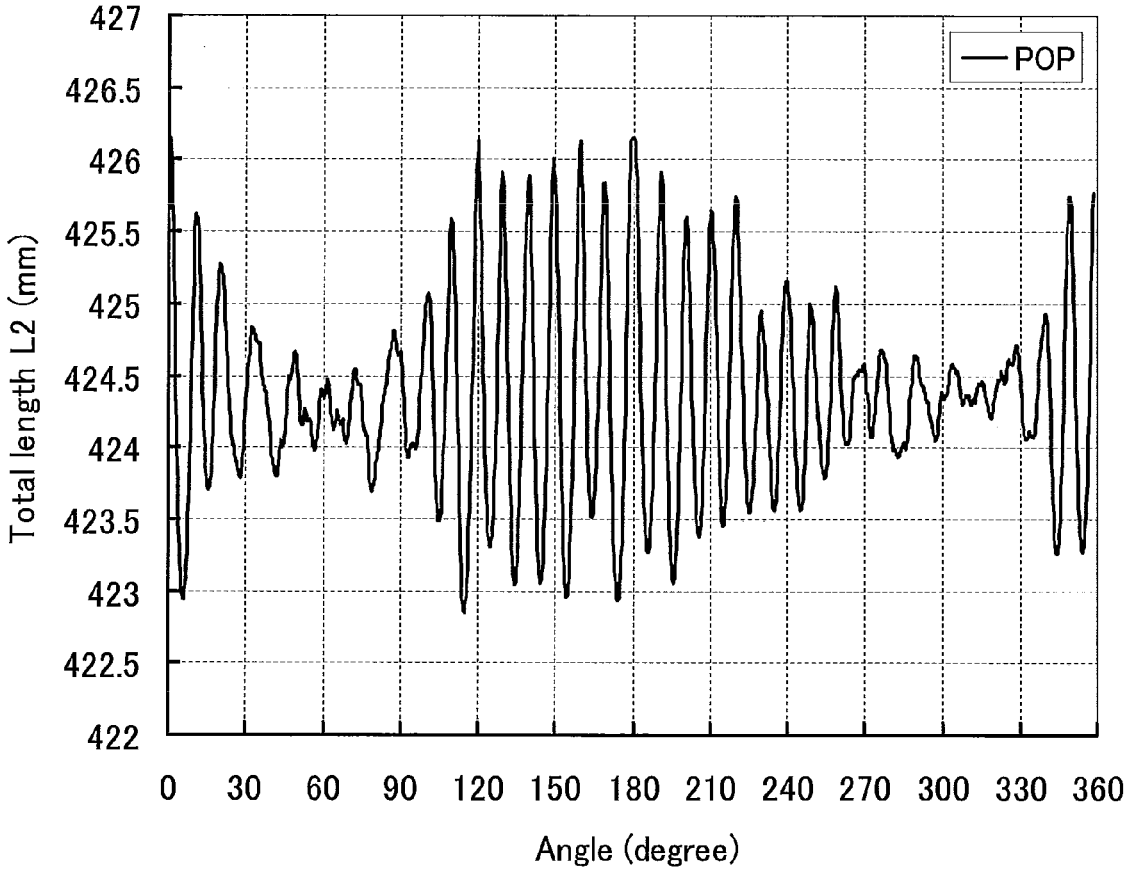
FIG. 19 is a graph for calculating a fluctuation range Ro of the golf ball in FIG. 17.

| Results of Evaluation | | | | | | |
|---|---|---|---|---|---|---|
| | | Example 1 | Example 2 | Example 3 | Compa. Example 1 | Compa. Example 2 |
| Pattern | | FIG. 2 | FIG. 8 | FIG. 11 | FIG. 14 | FIG. 17 |
| Total volume ($mm^3$) | | 550 | 550 | 550 | 555 | 520 |
| Graph | POP rotation | FIG. 7 | FIG. 10 | FIG. 13 | FIG. 16 | FIG. 19 |
| | PH rotation | FIG. 6 | FIG. 9 | FIG. 12 | FIG. 15 | FIG. 18 |
| Ro (mm) | | 1.77 | 1.53 | 1.00 | 2.48 | 3.30 |
| Rh (mm) | | 1.43 | 1.57 | 1.09 | 2.06 | 0.50 |
| dR (mm) | | 0.34 | −0.04 | −0.09 | 0.42 | 2.80 |
| Ao ($mm^{-2}$) | | 0.0032 | 0.0028 | 0.0018 | 0.0045 | 0.0063 |
| Ah ($mm^{-2}$) | | 0.0026 | 0.0029 | 0.0020 | 0.0037 | 0.0010 |
| dA ($mm^{-2}$) | | 0.0006 | −0.0001 | −0.0002 | 0.0008 | 0.0053 |

[Production of Ball of Example 1]

A rubber composition was obtained by kneading 100 parts by weight of a polybutadiene (trade name "BR-730", available from JSR Corporation), 30 parts by weight of zinc diacrylate, 6 parts by weight of zinc oxide, 10 parts by weight of barium sulfate, 0.5 parts by weight of diphenyl disulfide, and 0.5 parts by weight of dicumyl peroxide. This rubber composition was placed into a mold that included upper and lower mold halves each having a hemispherical cavity, and heated at 170° C. for 18 minutes to obtain a core with a diameter of 39.7 mm. On the other hand, a resin composition was obtained by kneading 50 parts by weight of an ionomer resin (trade name "Himilan 1605", available from Du Pont-MITSUI POLYCHEMICALS Co., LTD.), 50 parts by weight of another ionomer resin (trade name "Himilan 1706", available from Du Pont-MITSUI POLYCHEMICALS Co., LTD.), and 3 parts by weight of titanium dioxide. The above core was placed into a final mold having numerous pimples on its inside face, followed by injection of the above resin composition around the core by injection molding, to form a cover with a thickness of 1.5 mm. Numerous dimples having a shape that was the inverted shape of the pimples were formed on the cover. A clear paint including a two-component curing type polyurethane as a base material was applied to this cover to obtain a golf ball of Example 1 with a diameter of 42.7 mm and a weight of about 45.4 g. The golf ball has a PGA compression of about 85. The golf ball has the dimple pattern shown in FIG. 2.

[Production of Ball of Comparative Example 2]

A golf ball was obtained in a similar manner as Example 1, except the final mold was changed.

[Measurement of Flight Distance]

A driver with a titanium head (trade name "SRIXON W-505", available from SRI Sports Limited, shaft hardness: X, loft angle: 8.5°) was attached to a swing machine available from Golf Laboratories, Inc. A golf ball was hit under the conditions of: a head speed of 50 m/sec; a launch angle of about 11°; and a backspin rotation rate of about 2600 rpm, and the distance from the launch point to the landing point was measured. The measurement was done 6 times for each of PH rotation and POP rotation. The average values of the distances are as follows.

| | Example 1 | Comparative Example 2 |
|---|---|---|
| POP rotation | 267.0 yards | 259.9 yards |
| PH rotation | 267.5 yards | 271.7 yards |

As is clear from the results of the measurement, the difference between the flight distance at POP rotation and the flight distance at PHP rotation is small in Example 1. In Comparative Example 2, the flight distance at PH rotation is long, but the flight distance at POP rotation is short. If the method disclosed in JP-S61-284264 is applied to the golf ball of Comparative Example 2, the aerodynamic symmetry improves. However, in this case as well, the average flight distance is inferred to be short.

The dimple pattern described above is applicable to a one-piece golf ball, a multi-piece golf ball, and a thread-wound golf ball, in addition to a two-piece golf ball. The above description is merely for illustrative examples, and various modifications can be made without departing from the principles of the present invention.

What is claimed is:

1. A golf ball having a large number of dimples, the golf ball having a fluctuation range Rh and a fluctuation range Ro each of which is 1.9 mm or less, the fluctuation range Rh and the fluctuation range Ro being obtained by the steps of:

(1) assuming a line connecting both poles of the golf ball as a first rotation axis;

(2) assuming a great circle which exists on a surface of a phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining a region, of a surface of the golf ball, which is obtained by dividing the phantom sphere at the two small circles and which is sandwiched between the two small circles;

(5) determining 30240 points, on the region, arranged at intervals of a central angle of 3° in a direction of the first rotation axis and at intervals of a central angle of 0.25° in a direction of rotation about the first rotation axis;

(6) calculating a length L1 of a perpendicular line which extends from each point to the first rotation axis;

(7) calculating a total length L2 by summing 21 lengths L1 calculated based on 21 perpendicular lines arranged in the direction of the first rotation axis;

(8) determining a maximum value and a minimum value among 1440 total lengths L2 calculated along the direction of rotation about the first rotation axis, and calculating the fluctuation range Rh by subtracting the minimum value from the maximum value;

(9) assuming a second rotation axis orthogonal to the first rotation axis assumed at the step (1);

(10) assuming a great circle which exists on the surface of the phantom sphere of the golf ball and is orthogonal to the second rotation axis;

(11) assuming two small circles which exist on the surface of the phantom sphere of the golf ball, which are orthogonal to the second rotation axis, and of which an absolute value of a central angle with the great circle is 30°;

(12) defining a region, of the surface of the golf ball, which is obtained by dividing the phantom sphere at the two small circles and which is sandwiched between the two small circles;

(13) determining 30240 points, on the region, arranged at intervals of a central angle of 3° in a direction of the second rotation axis and at intervals of a central angle of 0.25° in a direction of rotation about the second rotation axis;

(14) calculating a length L1 of a perpendicular line which extends from each point to the second rotation axis;

(15) calculating a total length L2 by summing 21 lengths L1 calculated based on 21 perpendicular lines arranged in the direction of the second rotation axis; and

(16) determining a maximum value and a minimum value among 1440 total lengths L2 calculated along the direction of rotation about the second rotation axis, and calculating the fluctuation range Ro by subtracting the minimum value from the maximum value.

2. The golf ball according to claim 1, wherein an absolute value of a difference dR between the fluctuation range Ro and the fluctuation range Rh is 0.4 mm or less.

3. The golf ball according to claim 1, wherein an index Ah that is obtained by dividing the fluctuation range Rh by a total volume of the dimples is 0.0035 $mm^{-2}$ or less, and an index Ao that is obtained by dividing the fluctuation range Ro by the total volume of the dimples is 0.0035 $mm^{-2}$ or less.

4. The golf ball according to claim 3, wherein an absolute value of a difference dA between the index Ao and the index Ah is 0.0007 $mm^{-2}$ or less.

5. The golf ball according to claim 1, wherein a total volume of the dimples is 450 $mm^3$ or greater and 700 $mm^3$ or less.

6. The golf ball according to claim 1, wherein a ratio of a total area of the dimples to a surface area of the phantom sphere is 70% or greater and 95% or less.

7. A golf ball having a large number of dimples, the golf ball having a difference dR whose absolute value is 0.4 mm or less, the difference dR being obtained by the steps of:

(1) assuming a line connecting both poles of the golf ball as a first rotation axis;

(2) assuming a great circle which exists on a surface of a phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining a region, of a surface of the golf ball, which is obtained by dividing the phantom sphere at the two small circles and which is sandwiched between the two small circles;

(5) determining 30240 points, on the region, arranged at intervals of a central angle of 3° in a direction of the first rotation axis and at intervals of a central angle of 0.25° in a direction of rotation about the first rotation axis;

(6) calculating a length L1 of a perpendicular line which extends from each point to the first rotation axis;

(7) calculating a total length L2 by summing 21 lengths L1 calculated based on 21 perpendicular lines arranged in the direction of the first rotation axis;

(8) determining a maximum value and a minimum value among 1440 total lengths L2 calculated along the direction of rotation about the first rotation axis, and calculating a fluctuation range Rh by subtracting the minimum value from the maximum value;

(9) assuming a second rotation axis orthogonal to the first rotation axis assumed at the step (1);

(10) assuming a great circle which exists on the surface of the phantom sphere of the golf ball and is orthogonal to the second rotation axis;

(11) assuming two small circles which exist on the surface of the phantom sphere of the golf ball, which are orthogonal to the second rotation axis, and of which an absolute value of a central angle with the great circle is 30°;

(12) defining a region, of the surface of the golf ball, which is obtained by dividing the phantom sphere at the two small circles and which is sandwiched between the two small circles;

(13) determining 30240 points, on the region, arranged at intervals of a central angle of 3° in a direction of the second rotation axis and at intervals of a central angle of 0.25° in a direction of rotation about the second rotation axis;

(14) calculating a length L1 of a perpendicular line which extends from each point to the second rotation axis;

(15) calculating a total length L2 by summing 21 lengths L1 calculated based on 21 perpendicular lines arranged in the direction of the second rotation axis;

(16) determining a maximum value and a minimum value among 1440 total lengths L2 calculated along the direction of rotation about the second rotation axis, and calculating a fluctuation range Ro by subtracting the minimum value from the maximum value; and

(17) calculating the difference dR by subtracting the fluctuation range Rh from the fluctuation range Ro.

8. The golf ball according to claim 7, wherein a total volume of the dimples is 450 $mm^3$ or greater and 700 $mm^3$ or less.

9. The golf ball according to claim 7, wherein a ratio of a total area of the dimples to a surface area of the phantom sphere is 70% or greater and 95% or less.

* * * * *